United States Patent [19]

Reynolds

[11] 4,126,080

[45] Nov. 21, 1978

[54] HIGH VELOCITY ANTI-SURGE SPRING ASSEMBLY

[75] Inventor: George L. Reynolds, Cambridge, Ill.

[73] Assignee: The United States of America as represented by the Secretary of the Army, Washington, D.C.

[21] Appl. No.: 792,271

[22] Filed: Apr. 29, 1977

[51] Int. Cl.[2] ..... F41D 11/12

[52] U.S. Cl. ..... 89/199; 267/34

[58] Field of Search ..... 89/198, 199; 267/34, 267/64 B, 65 R

[56] References Cited

U.S. PATENT DOCUMENTS

| | | | |
|---|---|---|---|
| 1,397,377 | 11/1921 | Harpham | 267/34 |
| 2,497,350 | 2/1950 | Ferda | 89/198 |
| 3,276,763 | 10/1966 | Blatt | 267/64 B |
| 3,417,660 | 12/1968 | Harbrecht | 89/198 |
| 3,688,641 | 9/1972 | Curtis et al. | 89/198 |

*Primary Examiner*—Stephen C. Bentley

*Attorney, Agent, or Firm*—Nathan Edelberg; Robert O. Richardson

[57] ABSTRACT

A hydraulic spring combination to replace a long spring having surging characteristics in high velocity application with reciprocating parts in automatic and semiautomatic weapons. On recoil a rod penetrates a fluid chamber, causing a piston to move against a shorter spring at a slower velocity proportional to the ratio of rod cross-sectional area to the piston cross-sectional area. The shorter spring returns the piston to move the rod hydraulically to return the reciprocating parts to battery position.

5 Claims, 2 Drawing Figures

10
12
14
16
18
20
22
24
26
28
30
32
34
36

HIGH VELOCITY ANTI-SURGE SPRING ASSEMBLY

GOVERNMENT RIGHTS

The invention described herein may be manufactured and/or used by or for the Government for governmental purposes without the payment of any royalty thereon.

BACKGROUND OF THE INVENTION

In automatic and semiautomatic weapons there is normally found recoiling parts such as the bolt, carrier, etc., which reciprocate between a recoil position, such as after a cartridge has been fired, and an in-battery position, ready for the cartridge to be fired. The purpose of this reciprocating movement is to absorb recoil energy and to facilitate chambering of a fresh cartridge. The recoiling parts are urged toward the in-battery position by a helical action spring. The distance the bolt and carrier must travel dictates a fairly long spring must be used. An undesirable characteristic of these springs is that they do not compress evenly along the length of the spring at the high velocities attained by the recoiling parts of the weapon. This uneven compression induces a shock wave in the spring which is known as spring surging. This condition greatly reduces spring life and efficiency.

A simple solution to the spring surging problem would seem to be to reduce the weapon cyclic rate and hence the spring compression velocity. However, this is usually not practical or possible for several reasons. In fully automatic weapons, for example, the desired rate of fire determines the cyclic rate of the weapon and thus the velocity of the recoiling parts of the weapon. Another factor which must be considered in determining the recoil velocity is the amount of friction and other parasitic forces to be overcome. The recoiling parts usually perform several functions, for example, extracting and ejecting the fired round, searing the firing mechanism, and stripping and chambering a fresh round. The recoiling parts must have sufficient energy to accomplish this. Since velocity is proportional to energy, the velocity range is further restricted. Therefore, the cyclic rate cannot be reduced simply to overcome spring surging.

SUMMARY OF THE INVENTION

The present invention overcomes the problem of spring surging, with its reduction of spring life and reliability, previously discussed, by replacing the long action spring with a hydraulic spring system. The hydraulic system reduces the length and velocity of spring travel and serves as a combination spring-buffer. The system incorporates a rod attached to the recoiling parts of a weapon system. The rod extends through a movable piston into a chamber containing a hydraulic fluid. This chamber is closed at one end by a cap and at the other end by the piston. A short heavy spring urges the piston toward the chamber containing the hydraulic fluid. The spring preload may be varied by an adjusting nut in the end of the assembly.

As the weapon cycles, the rod is driven into the chamber, displacing the hydraulic fluid. The displaced fluid then moves the piston in opposition to the spring. The cross-sectional area of the piston and rod determines the piston velocity and displacement. For example, if the area of the piston is 10 times that of the rod, the piston velocity and displacement will be one-tenth that of the rod. Thus, a displacement of the rod of 10 inches yields a piston displacement of 1 inch. A rod velocity of 100 feet per second (fps) yields a piston and spring velocity of 10 fps. The areas of the piston and rod could, of course, be varied to provide the velocity and displacement reduction desired.

DETAILED DESCRIPTION OF PREFERRED EMBODIMENT

Figures 1, 2:
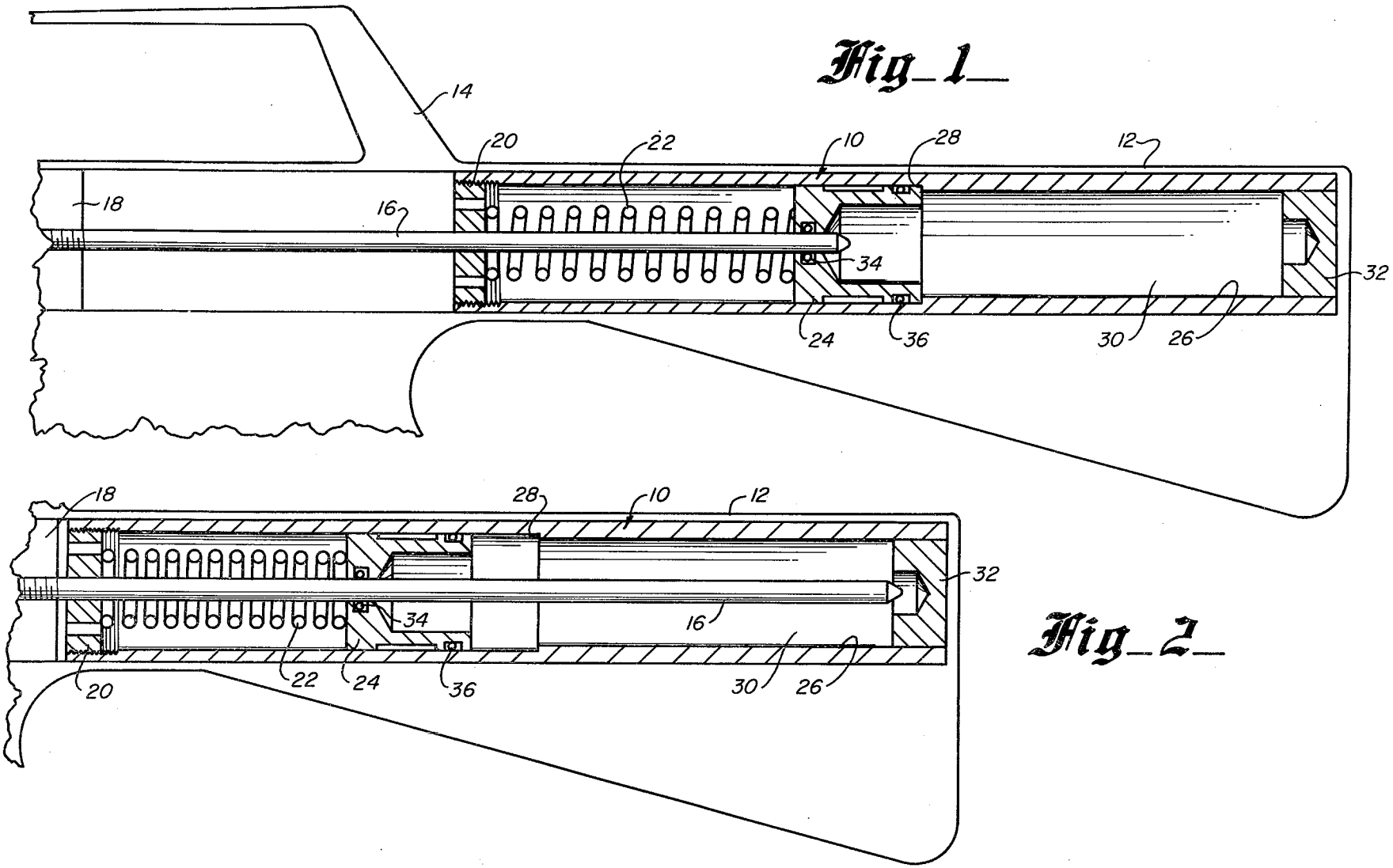
FIG. 1 is an elevational view in section showing the spring assembly and the weapon at its in-battery position.
FIG. 2 is similar to FIG. 1 but shows the weapon in the full recoil position.

Reference is made to FIG. 1 wherein there is shown a high velocity anti-surge spring assembly 10 in accordance with the present invention. The assembly may be mounted in the buttstock 12 of the weapon 14, as shown. This assembly replaces a conventional action spring, which urges the recoiling parts 18 forwardly to in-battery position. This assembly includes a rod 16 threadedly connected to the recoiling parts 18 of the weapon 14. The rod extends through an adjustable nut 20, a helical spring 22, and a hydraulic piston 24 and terminates in a hydraulic fluid chamber 26. The spring 22 is compressed between the nut 20 and the piston 24, urging the piston 24 toward the fluid chamber 26 and against a ridge 28 on the inner surface of chamber 26. This ridge 28 serves to limit the piston travel under the urging of spring 22. The nut 20 may be turned in or out to vary the preload on spring 22 as desired. In this manner spring force can be changed without changing springs. Contained within the chamber 26 is a hydraulic fluid 30. The chamber is closed by a cap 32. O-rings 34 and 36 provide the necessary sealing around the rod 16 and piston 24.

The system is activated when the weapon 14 is fired. As the recoiling parts 18 move rearwardly, or to the right in the drawings, the rod 16 is forced through the piston 24 into the fluid chamber 26, as shown in FIG. 2. The rod 16 displaces a volume of hydraulic fluid 30 equal to the volume of the rod that moved into chamber 26. The displaced fluid then acts on the piston 24 and moves it to the left in opposition to spring 22. Since the surface area of the piston is greater than that of the rod, the piston travel is much less than the rod travel. The velocity of the piston is also less than that of the rod for the same reason. The velocity or displacement of the piston may be calculated by multiplying the velocity or displacement (whichever is to be calculated) of the rod by the ratio of the cross-sectional area of the rod to the cross-sectional area of the piston. It can be seen that the piston velocity and displacement could be easily changed as desired by altering the area of the piston or rod.

The hydraulic fluid 30 is now pressurized by the piston 24 under tension of spring 22. The pressurized fluid 30 then acts on rod 16 to return it and the recoiling parts 18 of the weapon 14 to the in-battery position.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A hydraulic high velocity anti-surge spring assembly for replacing a long action spring in its high velocity application with reciprocating parts in automatic and semiautomatic weapons, said spring assembly urging said reciprocating parts to their in-battery position, said long action spring having an undesirable spring surging characteristic, said assembly reducing the length and velocity of spring travel of a shorter spring therein without reducing the cyclic rate of said reciprocating parts, said system comprising:

a chamber having a moveable piston therein, a rod affixed to reciprocating parts and insertable and moveable through said piston, said chamber having a fluid therein, a spring urging said piston against said fluid, said piston, upon movement against said fluid, expelling said rod from said fluid within said chamber.

2. A high velocity anti-surge spring assembly as in claim 1 wherein the cross-sectional area of said piston times its length of movement equals the cross-sectional area of said rod times its length of movement.

3. A high velocity anti-surge spring assembly as in claim 1 wherein said chamber has a stop therein to limit piston movement in one direction, said chamber having a nut threadedly inserted therein, said rod extending through said nut, said spring bearing between said nut and said piston to urge said piston against said stop.

4. A high velocity anti-surge spring assembly as in claim 3 wherein rotation of said nut regulates the tension of said spring.

5. A high velocity anti-surge spring assembly as in claim 3 wherein said spring is helically wound and said rod passes through the axis thereof.

* * * * *